United States Patent [19]

Seppanen

[11] Patent Number: 4,773,838

[45] Date of Patent: Sep. 27, 1988

[54] SLIPFORMING EXTRUDER FOR CASTING CONCRETE SLABS

[75] Inventor: Aimo Seppanen, Valkeakoski, Finland

[73] Assignee: Kt-Suunnittelu Oy, Valkeakoski, Finland

[21] Appl. No.: 32,619

[22] Filed: Apr. 1, 1987

[30] Foreign Application Priority Data

Apr. 7, 1986 [FI] Finland ..... 861471

[51] Int. Cl.[4] ..... B28B 1/26

[52] U.S. Cl. ..... 425/63; 264/71; 425/425; 425/426; 425/432

[58] Field of Search ..... 425/62, 63, 64, 111, 425/218, 219, 262, 426, 427, 429, 432, 456, 421, 428; 264/70, 71, 72, , 333, 75, 108

[56] References Cited

U.S. PATENT DOCUMENTS

| | | | |
|---|---|---|---|
| 214,374 | 4/1879 | Dows et al. | 425/300 |
| 850,428 | 4/1907 | Grant | 425/385 |
| 1,160,307 | 11/1915 | Mattes | 425/308 |
| 1,559,682 | 11/1925 | Doughty | 425/385 |
| 1,787,219 | 12/1930 | Trotter et al. | 425/385 |
| 2,031,899 | 2/1936 | Mattes | 425/385 |
| 2,582,645 | 1/1952 | Milliken et al. | 425/308 |
| 2,583,600 | 1/1952 | Schreiber | 425/208 |
| 3,044,391 | 7/1962 | Pellett | 425/62 |
| 3,781,154 | 12/1973 | Herbert et al. | 425/64 |
| 3,904,341 | 9/1975 | Putti | 425/64 |
| 3,972,666 | 8/1976 | Pandur | 425/208 |
| 4,125,348 | 11/1978 | Martens | 425/385 |
| 4,133,619 | 1/1979 | Wise | 425/64 |
| 4,568,503 | 2/1986 | Laine et al. | 425/426 |
| 4,608,216 | 8/1986 | Barsk | 425/427 |
| 4,668,447 | 5/1987 | Paakkinen | 425/426 |
| 4,674,970 | 6/1987 | Kankkunen | 425/456 |
| 4,674,971 | 6/1987 | Kankkunen | 425/456 |

FOREIGN PATENT DOCUMENTS

| | | | |
|---|---|---|---|
| 175930 | 4/1986 | European Pat. Off. | 264/71 |
| 64072 | 10/1983 | Finland . | |
| 64073 | 10/1983 | Finland . | |

*Primary Examiner*—Jay H. Woo
*Assistant Examiner*—C. S. Bushey
*Attorney, Agent, or Firm*—Birch, Stewart, Kolasch & Birch

[57] ABSTRACT

A method and an apparatus for casting concrete elements from a concrete mix by slipforming molding which involves extruding the concrete mix onto a bed, generating pressure into the concrete mix by a first set of extruder members and by compacting the concrete by moving at least one of the movable mold walls in a direction approximately parallel to its plane. The concrete mix is tamped into a more compacted form by protrusions formed onto at least one of the movable mold walls and projecting into the mix. The method and the apparatus achieves a high degree of compaction in the concrete mix by an uncomplicated method and apparatus without generating a loud noise.

6 Claims, 6 Drawing Sheets

SLIPFORMING EXTRUDER FOR CASTING CONCRETE SLABS

BACKGROUND OF THE INVENTION

The present invention relates to a method for slipforming molding of concrete elements from a concrete mix for casting concrete slabs.

The invention also concerns an apparatus for implementing the method.

The invention can be easily adapted to the manufacture of different kinds of concrete slabs. The invention is especially applicable to the fabrication of hollow-core concrete elements.

DESCRIPTION OF THE BACKGROUND ART

Finnish patent publications Nos. 64072 and 64073 describe a shear compaction method for compacting a stiff mix during the casting operation of concrete slabs. These method disclosures achieve compaction by means of contradirectional parallel shear displacements in the different zones of the mix within the mold by moving two opposite walls of the mold in a reciprocating, synchronized manner, with the walls moving mutually in the same direction.

Vibration is also used for compaction of the mix during molding by slipforming.

The method described in the aforementioned patent publications requires a complicated drive system because the angle of the mold walls relative to the vertical plane changes during compaction, while the shape of the mold is subjected to a continuous periodic state of change.

SUMMARY OF THE INVENTION

Furthermore, the use of vibration as a method of compaction is a noisy method which in effect wears down the equipment.

The present invention aims to overcome the disadvantages found in prior-art constructions and to present a completely new type of method and apparatus for the fabrication of concrete slabs.

The method in accordance with the invention is based on compacting a stiff concrete mix during a continuous slipforming molding of concrete slabs so that the different zonal areas of the stiff mix in the mold, especially the longitudinal opposing mold walls of the casting bed, are subjected to repetitive, reciprocating, synchronized movements of the opposing walls by moving reciprocatingly at least one of the walls of the slipforming mold in a direction essentially parallel to the slab surface, in which appropriately shaped protrusions, extending into the cast mix, are provided in the walls in order to obtain a simultaneous compaction effect.

In accordance with the invention, the slipforming extruder for implementing the method comprises a cover plate, side walls of the mold, a bottom plane, and members for feeding the stiff concrete mix into the mold, whereby at least one of the opposing walls of the slipforming mold is reciprocatingly movable either in the direction of the slipforming flow direction or in the direction of the mold wall surface transverse to the slipforming flow, and at least one of the movable walls is provided with protrusions which project toward the mold interior in order to facilitate a simultaneous compaction.

More specifically, the method for slipforming molding of concrete elements from a concrete mix in accordance with the invention is characterized by the concrete mix being extruded onto a casting bed by means of first extruder members, pressure being imposed into the concrete mix, the concrete mix being compacted by moving reciprocally at least one movable mold member in a direction approximately parallel to its plane, and tampering the concrete into a more compact from by means of introducing protrusions on at least one movable mold member into the concrete mix.

Furthermore, an apparatus for the manufacture of concrete elements by a slipforming molding method in accordance with the invention is characterized by at least one auger for initial compaction of the concrete mix, a first drive and power transmission means for driving the at least one auger, feeding mens for supplying the concrete mix onto the at least one auger, at least two opposed mold walls having protrusions extending from a side which faces the concrete mix, and second drive and power transmission means for reciprocating in a counterphased manner each of the at least two opposed mold walls having the protrusions.

The invention provides remarkable benefits. Thus, the method in accordance with the invention achieves, for instance, a high degree of compaction of a concrete mix by means of an uncomplicated apparatus without generating a loud noise.

In the following, the invention will be examined in more detail by means of exemplifying embodiments.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
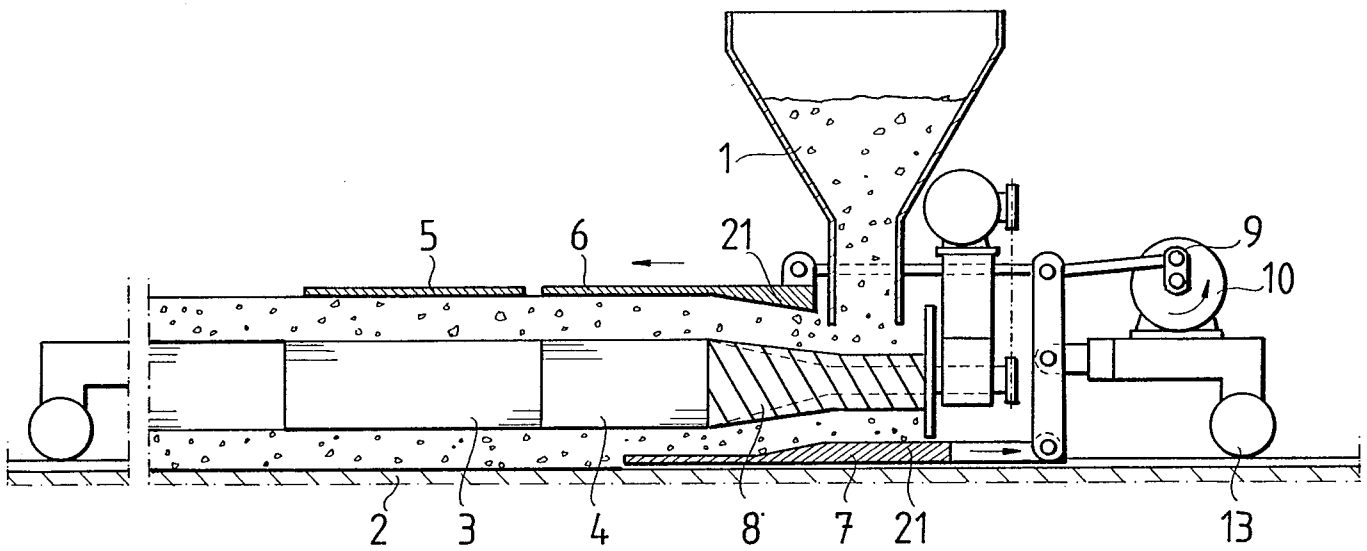
FIG. 1 shows a longitudinal cross section of a slipforming extruder for hollow-core concrete slabs in accordance with the present invention.

Referring in detail to the drawings, FIG. 1 illustrates a slipforming molding apparatus in accordance with the present invention. This apparatus operates according to an auger flight extruder principle with the concrete mix being fed from a hopper 1 by means of an auger 8. The auger is followed by a core-forming mandrel 4 for shaping the core into a desired form. The core-forming mandrel 4 is followed by a trowel tube 3 for the purpose of preventing the mix from collapsing during the final phase of the slipforming process. The apparatus moves on a bed 2 supported by wheels 13. The actual compaction is obtained by moving a trowel plate 6 and a mix guide plate 7 reciprocatingly in the flow direction of the extruder, parallel to the slab surface. Both the trowel plate 6 and the mix guide plate 7 are provided with protrusions 21 projecting into the cast mix. The protrusions 21 are wide in the crosswise direction, probably extending over the entire width of the plate. Hence, in the vicinity of the mold surface, the concrete mix tends to conform to the movement trajectory of the surface, whereby the concrete mix is internally sheared, resulting in a simultaneous compaction under the prevailing pressure. The synchronized reciprocating movement is provided by an auxiliary mechanism 9, in which an eccentric, driven by a motor 10, moves the trowel plate 6 and the mix guide plate 7 in a reciprocating, synchronized manner. The trowel plate 6 is followed by a stationary trowel plate 5 which finally shapes the slab surface into the desired form. Additionally, the apparatus comprises side mold walls 14.

Figure 2:
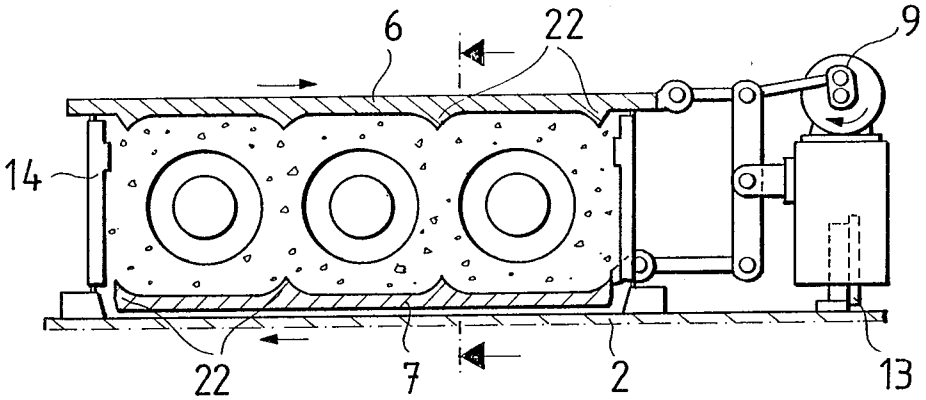
FIG. 2 shows a cross section of another embodiment of a slipforming extruder for hollow-core slabs in accordance with the present invention, especially illustrating the implementation of the transverse movement of compaction in relation to the molded mix.
Figure 3:
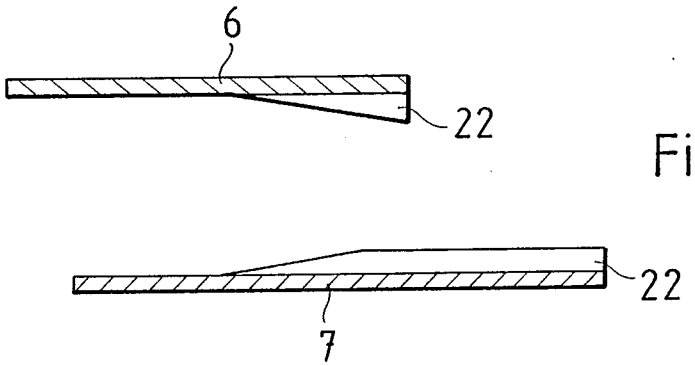
FIG. 3 shows a cross section of two different alternatives for profiles of the trowel plate in accordance with the present invention.

The compaction process of concrete mix can also be adapted in accordance with FIG. 2 so that the trowel plate 6 and the mix guide plate 7 are moved in a reciprocating, synchronized manner in opposite directions, crosswise to the molding flow direction, and parallel to the plate, by means of the eccentric 9. The compaction process of the concrete mix is most efficient when a combination of trajectories, as shown in FIGS. 1 and 2, is used. FIG. 3 illustrates in a longitudinal cross section the trowel plate 6 and the mix guide plate 7 used in the hollow-core slab extruder shown in FIG. 2. Compaction in the crosswise direction to the molding flow direction requires protrusions 22, shown in FIG. 2, to have the acute and narrow part extending to the mix in the crosswise direction.

Figure 4:
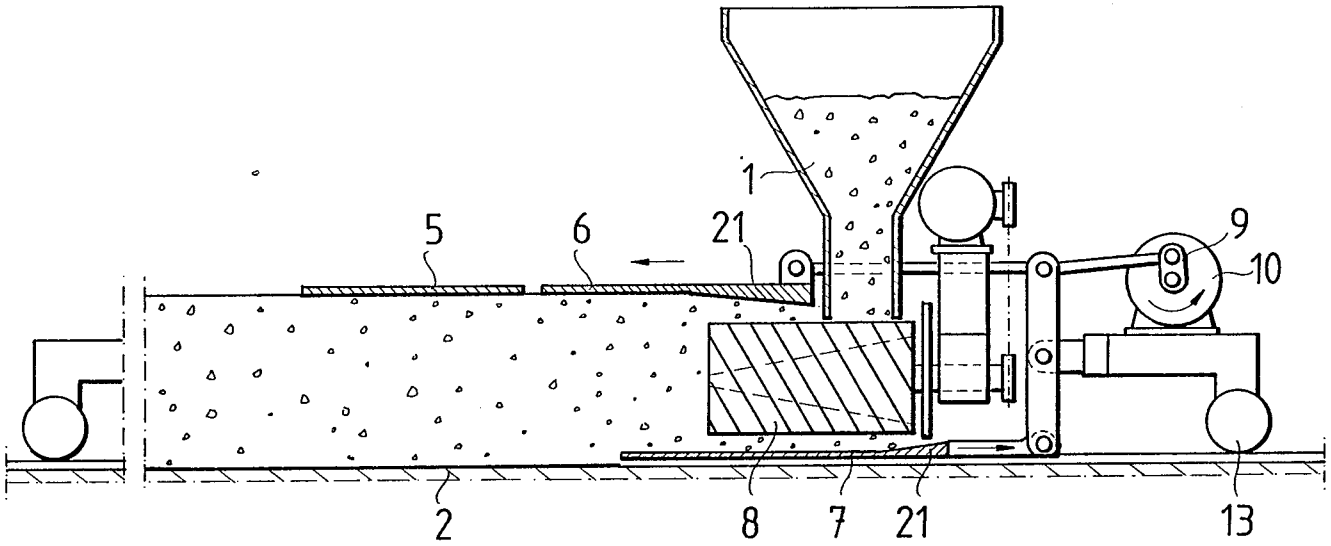
FIG. 4 shows a longitudinal cross section of a slipforming extruder for the fabrication of massive concrete slabs.

Extruding a massive slab by means of the slipforming method can be implemented in accordance with FIG. 4, whereby the extrusion pressure is generated by means of an auger. The actual compaction process is accomplished in a corresponding fashion by moving the trowel plate 6 and the mix guide plate 7 in opposite directions in a reciprocating, synchronized manner by means of the eccentric 9, whereby, in accordance with the invention, both the mix guide plate 7 and the trowel plate 6 are provided with protrusions 21 protruding into the mix for the improvement of compaction and tamping. In the fabrication of a massive slab, the movement of the mold walls crosswise to the mold flow direction as shown in FIG. 2 also improves the compaction of the concrete mix.

Figure 5:
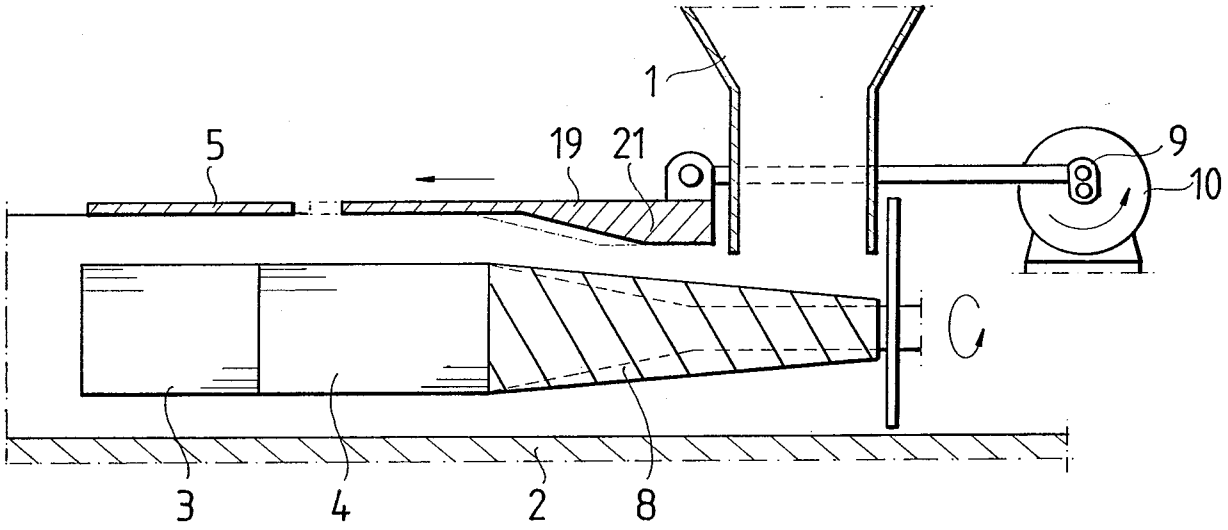
FIG. 5 shows a longitudinal cross section of a third embodiment of a slipforming extruder for hollow-core concrete slabs in accordance with the present invention, especially illustrating the shape of the trowel plate.

In the embodiment shown in FIG. 5, the trowel plate 19 moves reciprocatingly. When moving in the direction of the arrow, augmented by its protrusions 21, the plate 19 feeds the mix in the direction of the movement with a simultaneous compacting action.

Figure 6:
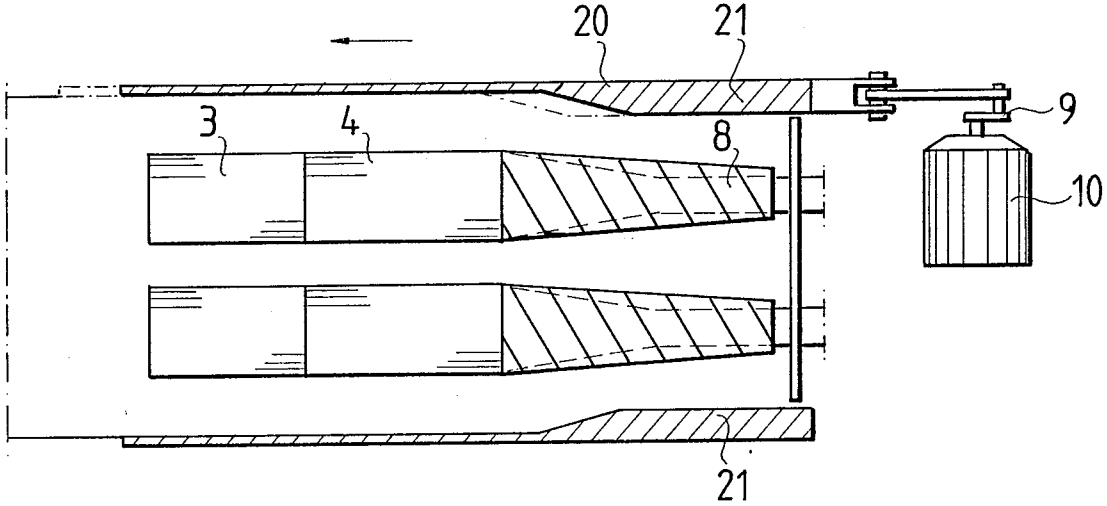
FIG. 6 shows in a partially cross-sectional top view a fourth embodiment of a slipforming extruder in accordance with the present invention with movable side molds.
Figure 7:
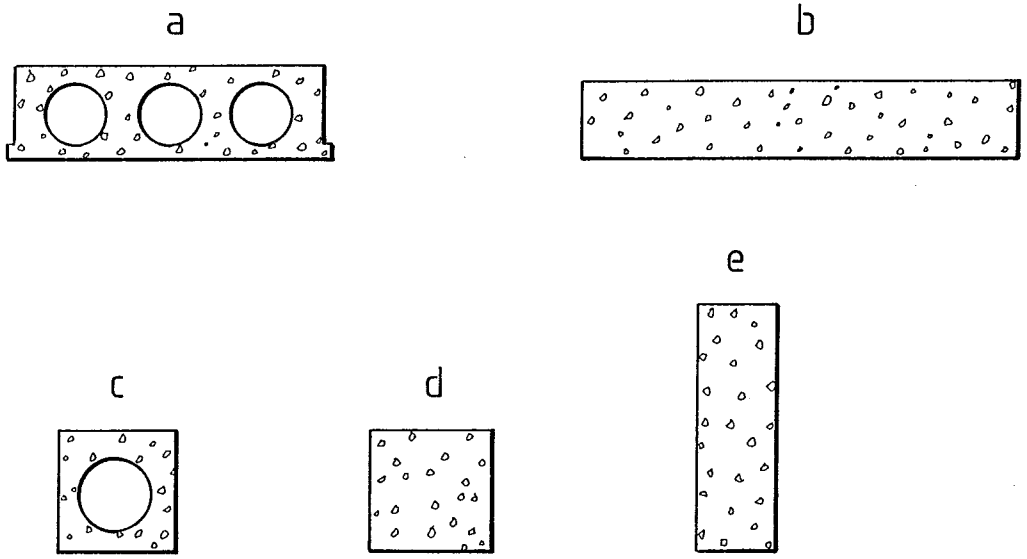
FIG. 7 shows cross-sectional views of concrete slabs which are capable of being manufactured by means of an apparatus in accordance with the present invention.

FIG. 6 shows an adaptation of the invention to the movement of the side walls. Here, the side walls 20 are reciprocatingly moving, and, when moving in the direction of the arrow, the wall 20 feeds the mix by the aid of its protrusion 21, simultaneously compacting the concrete in accordance with the invention. This embodiment is applicable in, for instance, the manufacture of hollow-core slabs, massive slabs, beams, and like concrete products with the different cross sections shown in FIG. 7.

The frequency of the reciprocating movement varies in the range of 20 . . . 1000 reciprocatory cycles per minute, preferably at about 300 cycles/min. The length of the reciprocating movement of the mold walls varies in the range of 0.5 . . . 50 mm, and is preferably about 10 mm.

The protrusions 21, 22 of the compacting surfaces are preferably adapted to have the maximum projection of the protrusions in the vicinity of the hopper 1 and then steadily diminishing towards the final end of the slipforming extruder, whereby the finished product will be free of impressions from the protrusions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for the manufacture of concrete elements by a slipforming molding method, said apparatus comprising:

at least one auger for initial compaction of concrete mix;

first drive and power transmission means for driving the at least one auger;

feeding means for supplying the concrete mix onto the at least one auger;

at least two opposed mold walls having protrusions extending from a side which faces the concrete mix; and second drive and power transmission means for reciprocating in a counterphased manner each of the at least two opposed mold walls having the protrusions.

2. The apparatus as claimed in claim 1, wherein the protrusions of the at least two opposed walls have the largest extensions at an end of the mold closest to the feeding means and diminishing in a direction away from the feeding means.

3. The apparatus as claimed in claim 1, wherein the at least two opposed mold walls are located in a generally horizontal plane.

4. The apparatus as claimed in claim 1, wherein the at least two opposed mold walls are located in a generally vertical plane.

5. The apparatus as claimed in claim 1, wherein the at least two opposed mold walls are located in both a generally horizontal and a generally vertical plane.

6. The apparatus as claimed in claim 1, wherein the at least two opposed mold walls are movable in a direction generally perpendicular to a flow direction of a slipforming extruder.

* * * * *